US007832031B1

(12) United States Patent
Lupo

(10) Patent No.: US 7,832,031 B1
(45) Date of Patent: Nov. 16, 2010

(54) BUNK BED WITH INTEGRAL STAIRCASE

(76) Inventor: Anthony C. Lupo, 891 Royalwood La., Oviedo, FL (US) 32765

( * ) Notice: Subject to any disclaimer, the term of this patent is extended or adjusted under 35 U.S.C. 154(b) by 3 days.

(21) Appl. No.: 12/458,952

(22) Filed: Jul. 28, 2009

(51) Int. Cl.
*A47B 83/00* (2006.01)
*A47C 19/20* (2006.01)
*A47C 19/22* (2006.01)

(52) U.S. Cl. ..... 5/9.1; 5/2.1; 5/308; 312/237

(58) Field of Classification Search ..... 5/2.1, 5/9.1, 308; 108/34, 35; 312/235.1, 237
See application file for complete search history.

(56) References Cited

U.S. PATENT DOCUMENTS

| | | | | |
|---|---|---|---|---|
| 2,888,687 | A | 6/1959 | Lindsey | |
| 3,950,796 | A * | 4/1976 | Hollingsworth | 5/2.1 |
| 4,139,077 | A | 2/1979 | Pena, Jr. | |
| 4,193,146 | A | 3/1980 | Fredman et al. | |
| 4,218,793 | A | 8/1980 | Hooker | |
| 4,253,204 | A | 3/1981 | Tasaka | |
| 4,359,793 | A * | 11/1982 | Hosono | 5/100 |
| D277,433 | S | 2/1985 | Hull | |
| 5,111,540 | A | 5/1992 | Caya | |
| 5,540,491 | A * | 7/1996 | Wu | 312/237 |
| 6,314,595 | B1 | 11/2001 | Price | |
| 6,568,001 | B2 | 5/2003 | Walsh | |
| 6,721,969 | B1 * | 4/2004 | Lupo et al. | 5/9.1 |
| 6,966,080 | B2 * | 11/2005 | Connell et al. | 5/9.1 |
| D513,370 | S | 1/2006 | Nobile | |

FOREIGN PATENT DOCUMENTS

| | | |
|---|---|---|
| CA | 2066846 | 10/1992 |
| DE | 20 2006 012 792 | 9/2007 |
| EP | 734665 | 10/1996 |
| JP | 2002-177076 | 6/2002 |

OTHER PUBLICATIONS

Website, http://www.discoveryworldfurniture.com/discovery-collection.htm, series of bunk style and other beds, one sheet printed from the internet on Apr. 21, 2009.

Website, http://www.nationalfurnishing.com/cgi-bin/ccp51/cp-app.cgi?rrc=N&affl=&pq=ste_prod&ref=3011_304Apc, bunk bed with stairs & storage drawers, on sheet printed from the internet on Apr. 21, 2009.

Website, http://www.sendmetomyroom.com/enco.html, series of bunk beds with ladders or stairs and storage drawers, on sheet printed from the internet on Apr. 21, 2009.

* cited by examiner

*Primary Examiner*—Michael Trettel
(74) *Attorney, Agent, or Firm*—Richard C. Litman

(57) ABSTRACT

The bunk bed with integral staircase includes upper and lower bunks with a set of steps or stairs assembled integrally therewith as a single unit. The staircase includes a chest of drawers therein to provide storage. The staircase structure is configured to allow certain components to be interchanged from one side to the other, permitting the staircase to be assembled to either end of the bunk bed structure as desired. The drawers of the chest extend laterally from the side of the staircase, and may be removed, turned around, and reinstalled in the opposite side of the staircase as desired, according to which end of the bunks the staircase is attached. The bed structure, and particularly the lower bunk, may include additional features, such as additional storage drawers therebeneath, and/or the lower bunk may have a greater width than the upper bunk.

20 Claims, 14 Drawing Sheets

BUNK BED WITH INTEGRAL STAIRCASE

BACKGROUND OF THE INVENTION

1. Field of the Invention

The present invention relates generally to furnishings, and particularly to a bunk bed with integral staircase that has a set of stairs that can be assembled to either end of the beds, as desired.

2. Description of the Related Art

Bunk beds have been known for a considerable period of time, and have proven to be quite efficient in providing compact sleeping facilities for families with multiple children and in college dorms, etc. Conventionally, a ladder is used to access the upper bunk, rather than a set of steps or a staircase. While a ladder can provide adequate access, it may be difficult for some people, particularly younger children, to access the upper bunk using a ladder.

Accordingly, some bunk bed systems have been provided with a set of steps or a staircase to access the upper bunk. The additional floor space required is often compensated for by installing some form of storage beneath the steps. The steps are generally a separate component and remain unattached to the bunk bed structure, in order to provide greater versatility for their location at either end of the bed assembly. This separate step or staircase configuration has its drawbacks, e.g., the lack of stability that would be provided by connecting it to the bunk bed assembly and the possibility of the steps sliding away from the bed assembly if some lateral force is applied to the steps during use.

As a result, many bunk bed constructors have attached the steps to the bed assembly, at one end or the other. This usually limits the versatility of the bed and step assembly, as it is not generally possible to alter the arrangement of the steps relative to the bed assembly without major modification to the steps and/or bed.

The present inventor is aware of various bunk bed, ladder, and step configurations that have been developed in the past. An example of such is found in European Patent No. 734,665, published on Oct. 2, 1996. This reference describes (according to the drawings and English abstract) a bunk bed assembly in which the two beds may pivot from their attachment to a common vertical structure, folding into the structure for storage. A ladder attaches to both bunks, with the ladder being removable to allow the two bunks to fold pivotally for storage.

Japanese Patent No. 2002-177,076, published on Jun. 25, 2002, describes (according to the drawings and English abstract) a single bed structure in which the bed may be installed in either the lower level or upper level thereof. When the bed is installed at the lower level, the ladder is used as a fence to prevent an infant or small child from rolling out of the bed. When the bed is installed at the upper level, the ladder is used to access the bed.

Finally, German Patent No. 20-2006-012,792, published on Sep. 27, 2007, describes (according to the drawings; no English abstract was provided) a ladder having a detachable panel that may be secured over the lower rungs to block access thereto, to prevent persons from climbing the ladder. The panel may be removed when desired to provide access to the ladder.

None of the above inventions and patents, taken either singly or in combination, is seen to describe the instant invention as claimed. Thus, a bunk bed with integral staircase solving the aforementioned problems is desired.

SUMMARY OF THE INVENTION

The bunk bed with integral staircase includes a staircase having a chest of drawers installed therein, with the drawers opening or extending laterally from the side of the steps. The staircase and drawers are installed as an integral unit at one end of the bunk bed structure. The bed structure and the staircase share certain common components. However, the specific construction of the assembly permits the staircase to be installed to either end of the bunk bed structure, and/or removed once installed and reinstalled to the opposite end of the bed structure. To accomplish this, the chest of drawers is removed from the staircase, turned around, and reinstalled in the staircase with the drawers extending to the opposite side from their previous installation. Other structure is exchanged from one side of the staircase to the other, permitting the staircase to be attached to the opposite end of the bed structure. The bed structure, particularly the lower bunk, may include additional features, such as additional storage drawers therebeneath and/or the lower bunk may be wider than the upper bunk.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
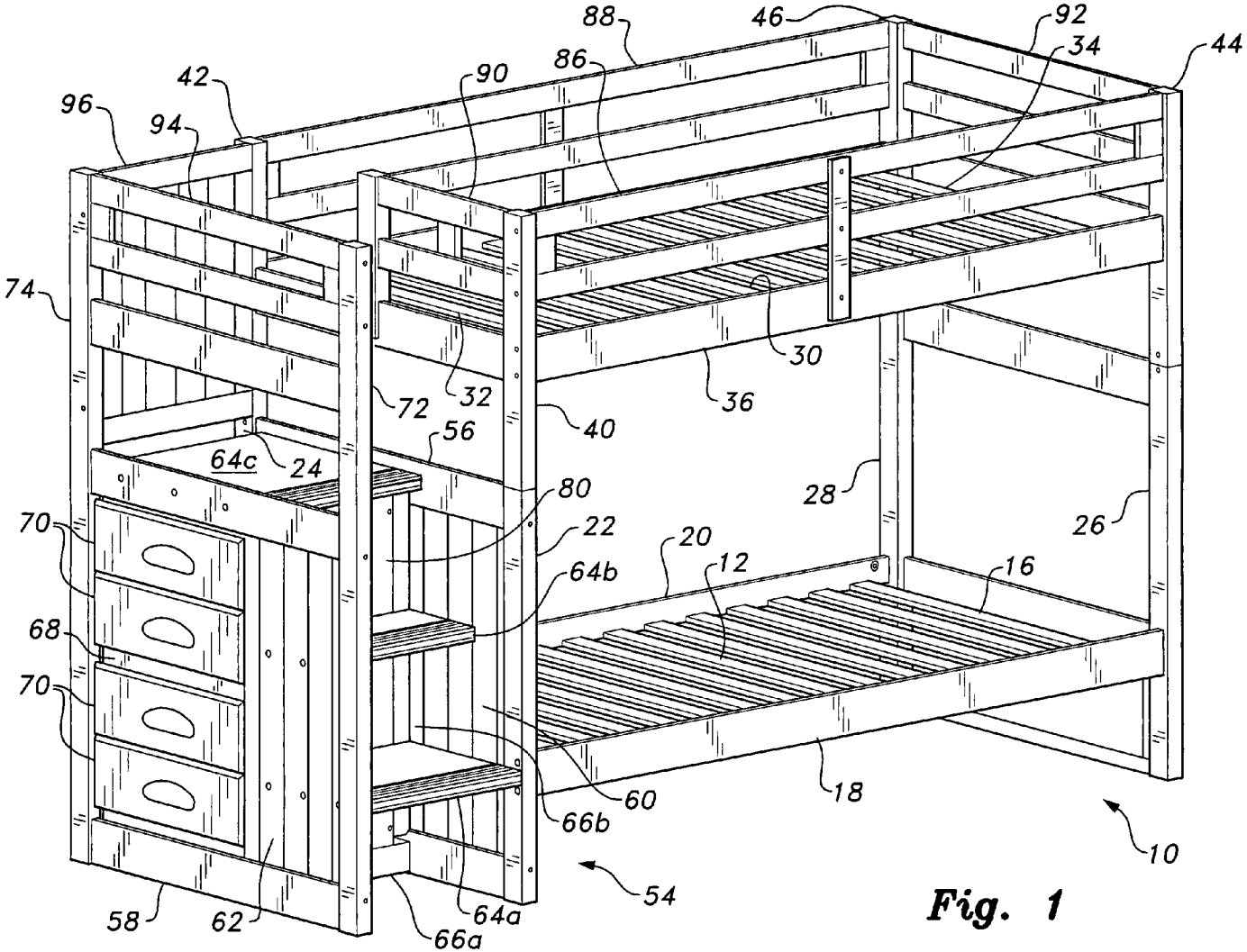
FIG. 1 is a perspective view of a first embodiment of a bunk bed with integral staircase according to the present invention, showing its general features.
Figure 2:
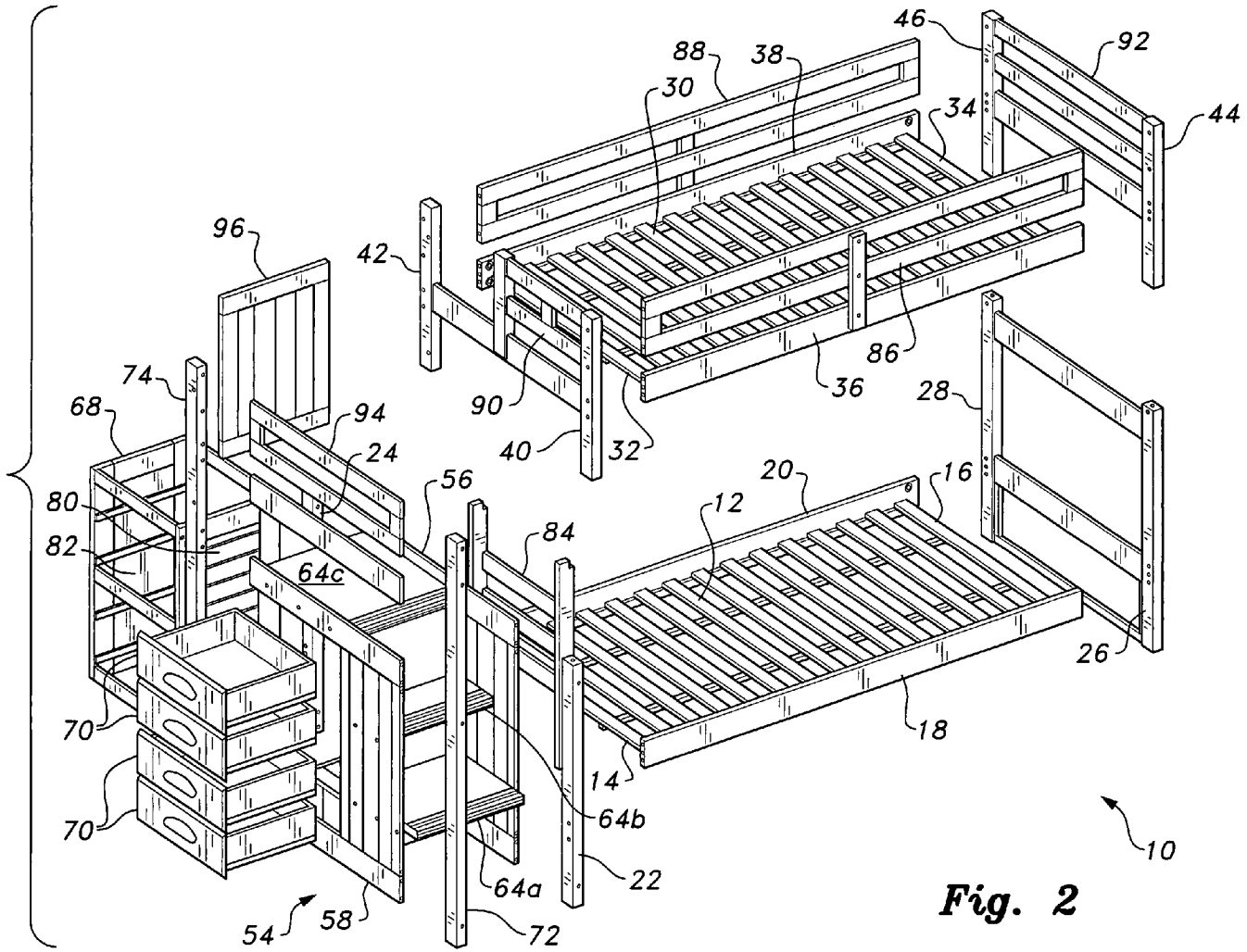
FIG. 2 is an exploded perspective view of the bunk bed with integral staircase of FIG. 1, showing the relationship between various components.
Figure 3:
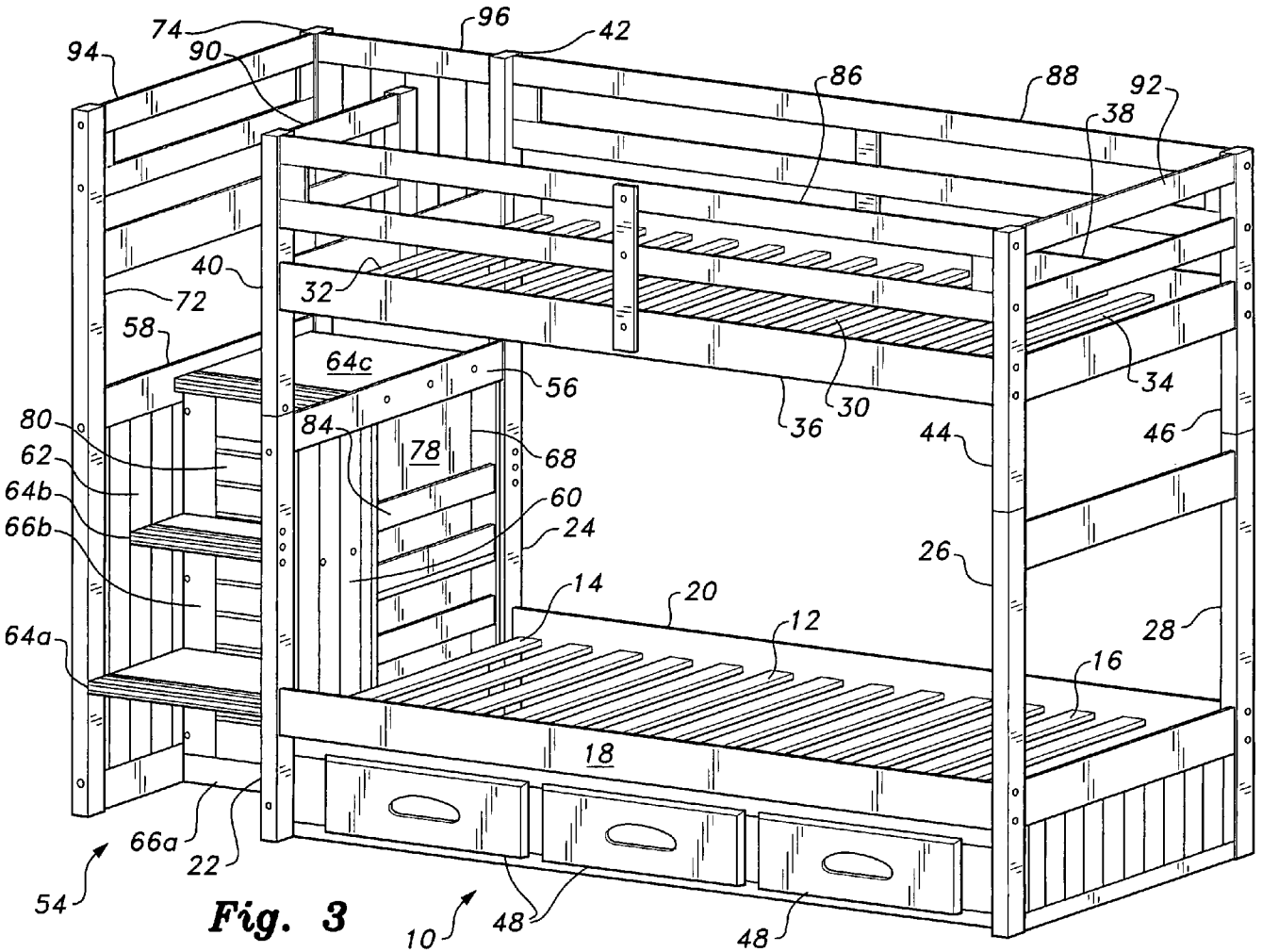
FIG. 3 is a perspective view of an alternate embodiment of a bunk bed with integral staircase according to the present invention, showing the addition of a set of drawers beneath the lower bunk.
Figure 4:
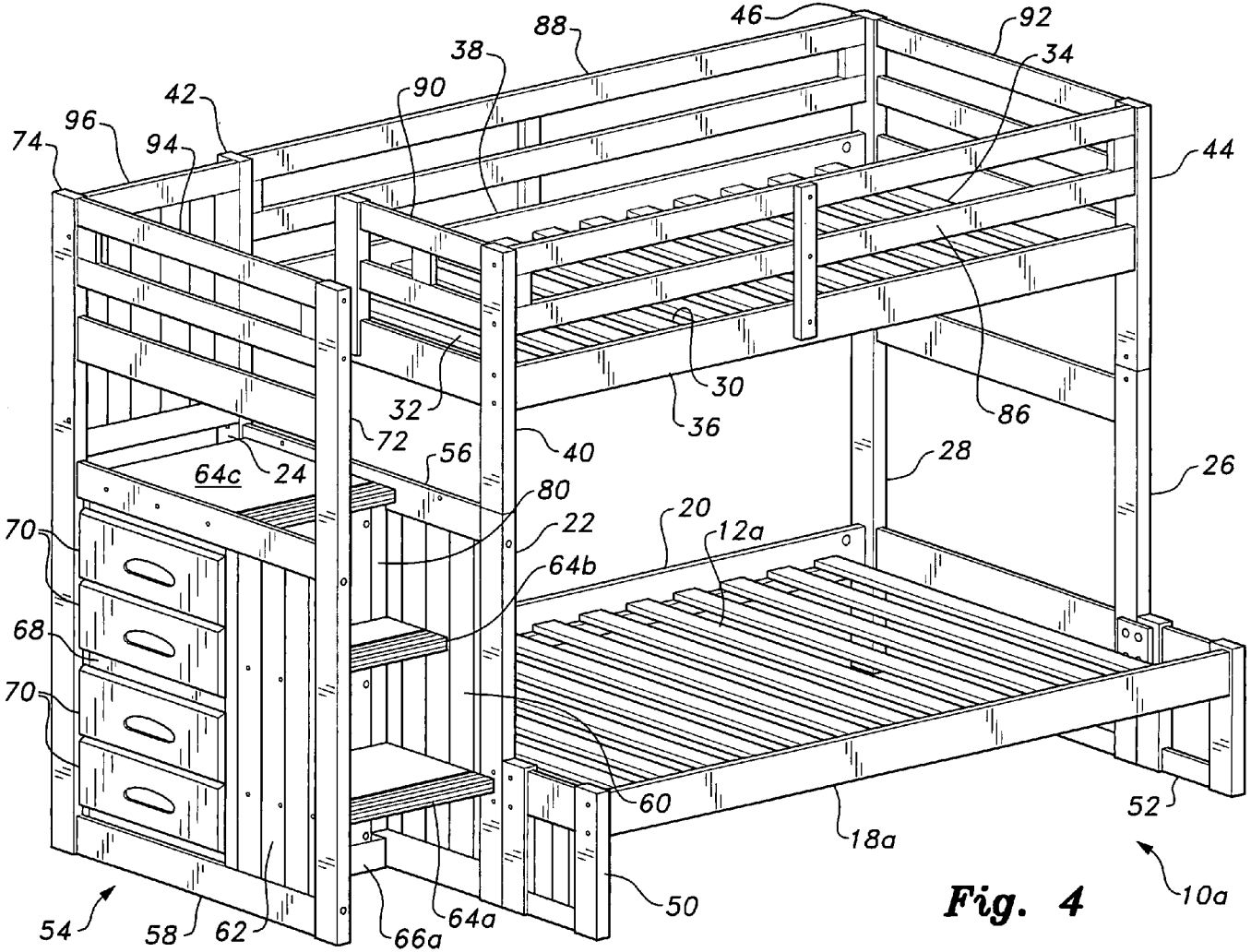
FIG. 4 is a perspective view of another alternate embodiment of a bunk bed with integral staircase according to the present invention, showing a lower bunk having a greater width than the upper bunk.

The present invention comprises various embodiments of a bunk bed with integral staircase in which the structure of the bunk beds and the staircase permit the staircase to be affixed to either end of the bunks and/or to be relocated readily from one end to the other, as desired. FIGS. 1 through 3 of the drawings provide views of a first embodiment of the bunk bed and staircase assembly 10, with FIGS. 3 and 4 illustrating additional options or accessories that may be included with the bed assembly. The assembly 10 includes a lower bunk 12 having a first end 14 (shown in FIGS. 2, 3, and 14) and opposite second end 16, a front side 18 (i.e., the side toward which the steps are oriented), and an opposite rear side 20. The first end 14 includes a forward post 22 and rearward post 24 (shown most clearly in FIGS. 3 and 14) comprising a lower bunk first end post pair, with the opposite second end 16 having a forward post 26 and rearward post 28 comprising a lower bunk second end post pair.

The upper bunk 30 is similarly configured, with the primary differences being the shorter posts and the railing extending around all sides. The upper bunk 30 includes a first end 32 and opposite second end 34, a front side 36 (i.e., the side toward which the steps are oriented), and an opposite rear side 38. The first end 32 includes a forward post 40 and rearward post 42 comprising an upper bunk first end post pair, with the opposite second end 34 having a forward post 44 and rearward post 46 comprising an upper bunk second end post pair. The first end post pair 40, 42 and second end post pair 44, 46 of the upper bunk 30 install atop their corresponding lower bunk end post pairs 22, 24 and 26, 28 to stack the upper bunk 30 atop the lower bunk 12.

FIGS. 3 and 4 illustrate additional accessories or options that may be included with the bunk bed assembly 10, as desired. In FIG. 3, a series of storage drawers 48 is shown installed beneath the lower bunk 12. The remainder of the structure illustrated in FIG. 3 is identical to that shown in FIGS. 1 and 2. In FIG. 4, the bunk bed assembly 10*a* has been modified by widening the lower bunk 12*a* to a width greater than that of the standard upper bunk 30. First and second end lateral extensions, respectively 50 and 52, have been added to the lower portions of the respective first and second end forward posts 22 and 26 for the lower bunk 12*a*. The forward side 18*a* of the lower bunk 12*a* extends between the outboard ends of the two extensions 50 and 52, thus allowing the lower bunk 12*a* to be widened. It will be seen that the lower bunk drawer additions 48 shown in FIG. 3 may be readily added to the widened lower bunk 12*a* of FIG. 4, if so desired.

Figure 14:
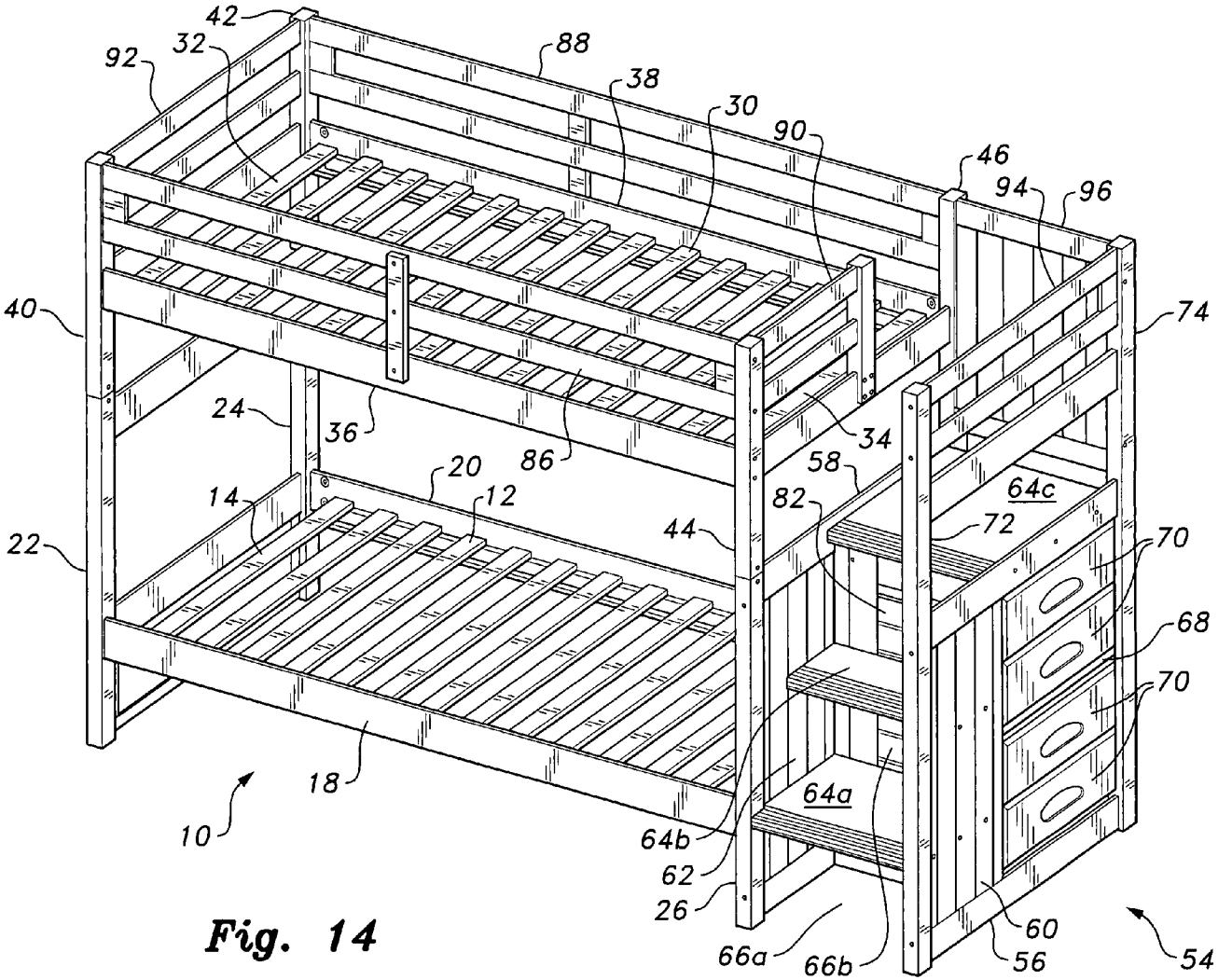
FIG. 14 is a perspective view of the completed bunk bed with integral staircase according to the present invention after completing the steps illustrated in FIGS. 5 through 13, showing the staircase installed at the opposite end from that shown in FIGS. 1 through 4.

FIGS. 5 through 12 illustrate the staircase component 54 of the bunk bed assembly 10 or 10*a*, and the procedure for converting the staircase 54 from its attachment to the first ends of the bunks, as shown in FIGS. 1, 3, and 4, to attachment to the second ends of the bunks, as shown in FIG. 14. The staircase assembly 54 essentially comprises mutually opposed first and second sides, respectively 56 and 58, with the paneled front portions 60 and 62 of the two sides including a series of steps 64*a* and 64*b* therebetween. More or fewer steps may be provided as desired. The upper landing 64*c* extends between the upper edges of the two sides 56, 58, and comprises the top of the staircase assembly 54. The steps 64*a*, 64*b* are open therebeneath, with these below step open areas 66*a*, 66*b* serving as open storage areas for the bunk bed assembly 10.

Figure 10:
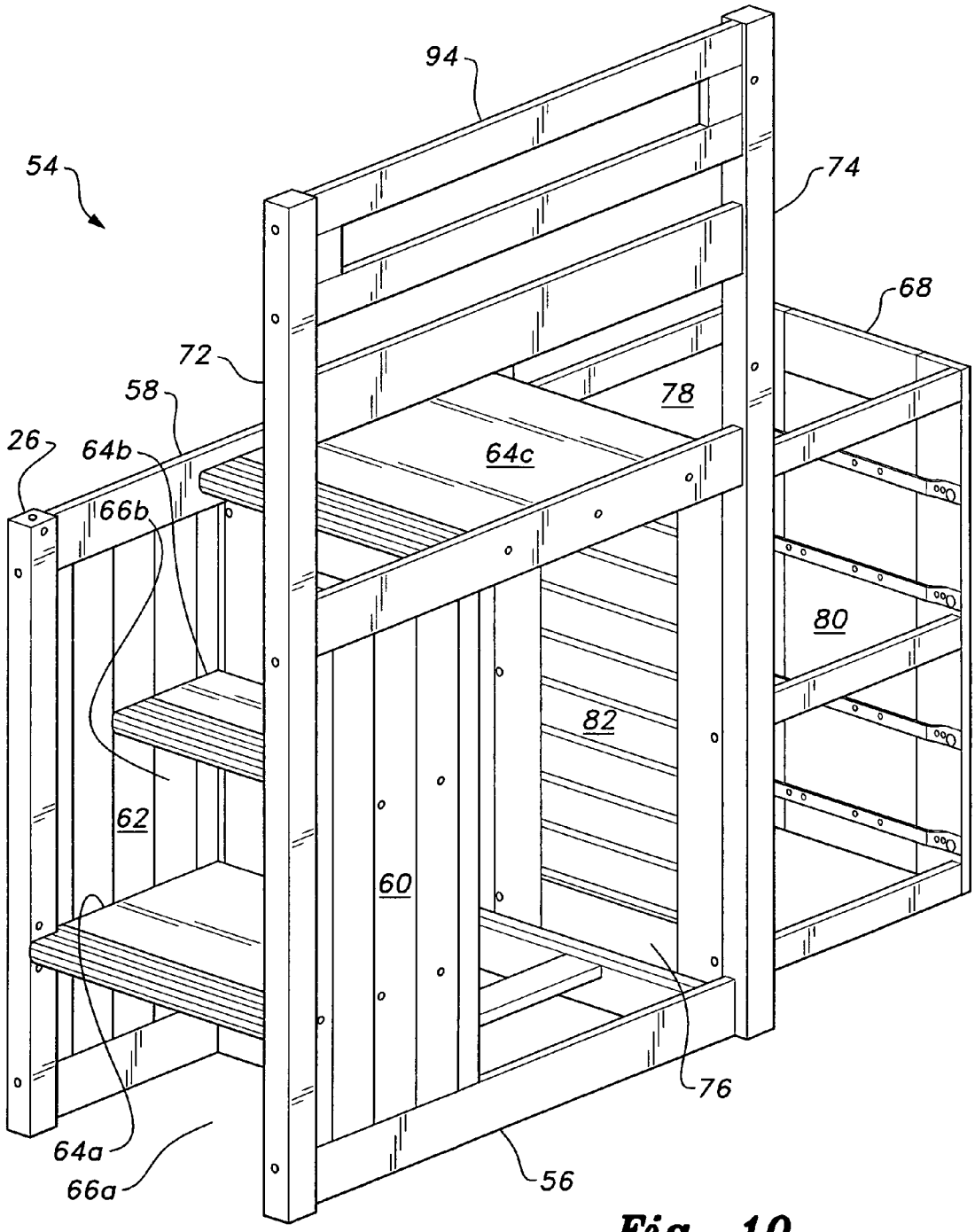
FIG. 10 is a perspective view of the staircase assembly and one end of a bunk bed with integral staircase according to the present invention, showing the sixth step in converting the staircase for installation from one end of the bunks to the other end.
Figure 11:
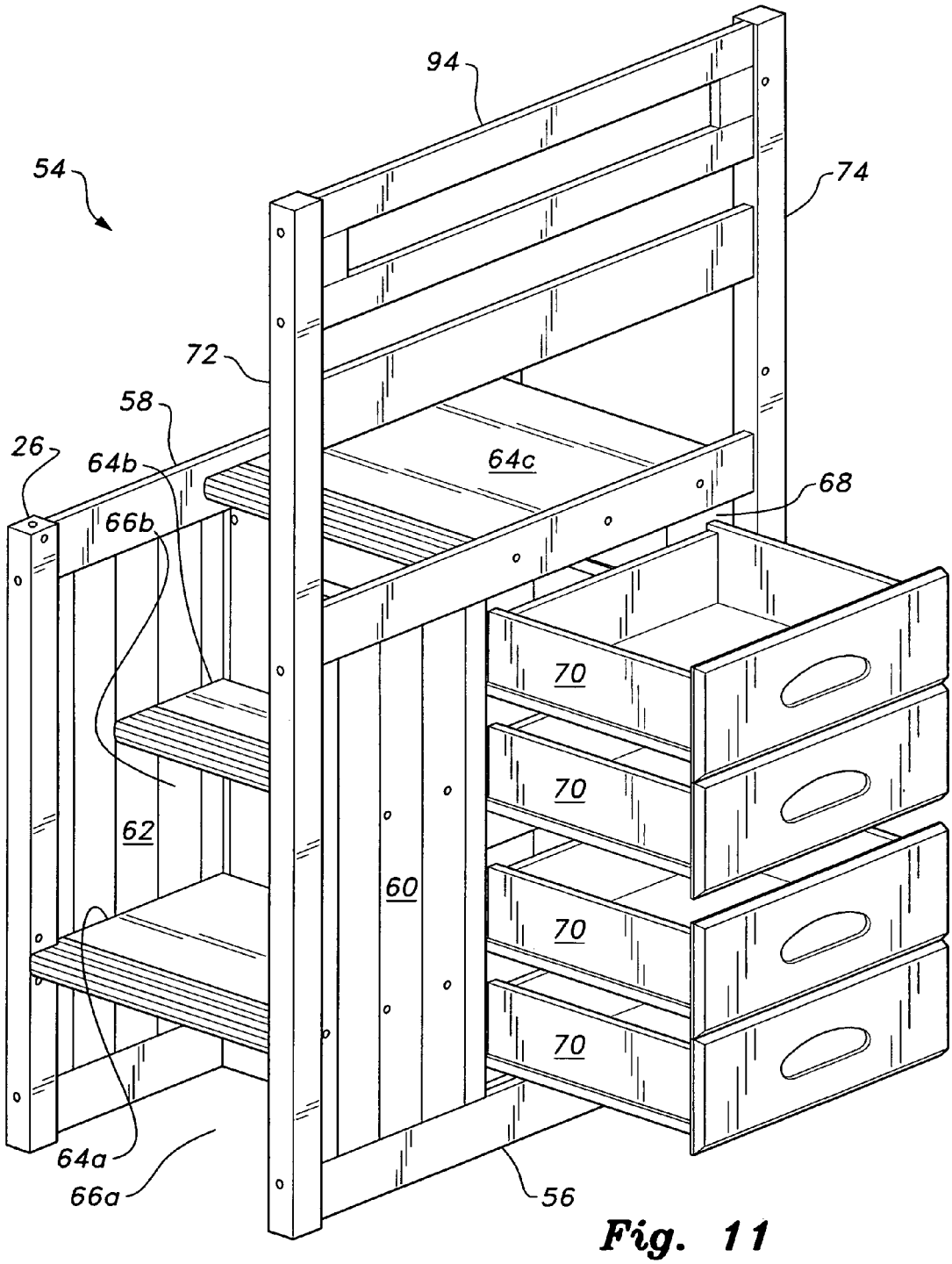
FIG. 11 is a perspective view of the staircase assembly and one end of the bunk bed with integral staircase according to the present invention, showing the seventh step in converting the staircase for installation from one end of the bunks to the other end.

The staircase assembly 54 includes additional storage beneath the upper landing 64*c*, in the form of a chest of drawers 68 containing a series of individual drawers 70. It will be seen that more or fewer drawers may be provided, or the storage space may comprise one or more shelves, either open or enclosed by a hinged door, or some combination of these storage units may be provided as desired. As the two sides 56, 58 of the staircase assembly 54 are open behind the paneled forward portions 60 and 62 thereof, the chest of drawers 68 may be oriented to allow the drawers 70 to open laterally from the staircase 54, e.g., through the second side 58 thereof as shown in FIGS. 1, 2, and 5 through 7. The orientation of the chest of drawers 68 and drawers 70 may be readily reversed to provide for opening from the first side 56 if so desired, as shown in FIGS. 11 and 14. The means for accomplishing this is illustrated in FIGS. 7 through 12 and discussed in detail further below.

The corners of the staircase assembly 54 are defined by relatively tall forward and rearward outboard posts, respectively 68 and 70, and opposite forward and rearward lower bunk posts. The posts of the outboard post pair 68 and 70 are preferably sufficiently tall to reach from the floor to the upper edge of the railing provided about the landing 64*c* and upper bunk 30, but each may be formed as two shorter lengths if so desired. The forward and rearward lower bunk posts comprise either the first end post pair 22, 24 or the second end post pair 26, 28, depending upon which end the staircase assembly 54 is attached. In the examples of FIGS. 1 through 5, it will be seen that the outboard post pair 68, 70 is attached to the ends of the second side 58 of the staircase assembly 54, while the lower bunk first end post pair 22, 24 is attached to the ends of the first side 56, thereby attaching the staircase assembly 54 to the first end 14 of the lower bunk 12.

The staircase assembly 54 is preferably provided as a pre-assembled structure, but with the outboard post pair 68, 70 and lower bunk post pair 22, 24 or 26, 28 remaining unattached to the staircase assembly 54 in order to allow the owner or user to install the staircase assembly 54 to either end of the bunks 12 and 30 as desired. Structural rigidity for the staircase assembly 54 may be provided by shipping blocks (not shown) temporarily installed along each of the edges of the two sides 56, 58 in lieu of the outboard post pair 68, 70 and lower bunk post pair 22, 24 or 26, 28.

Figure 5:
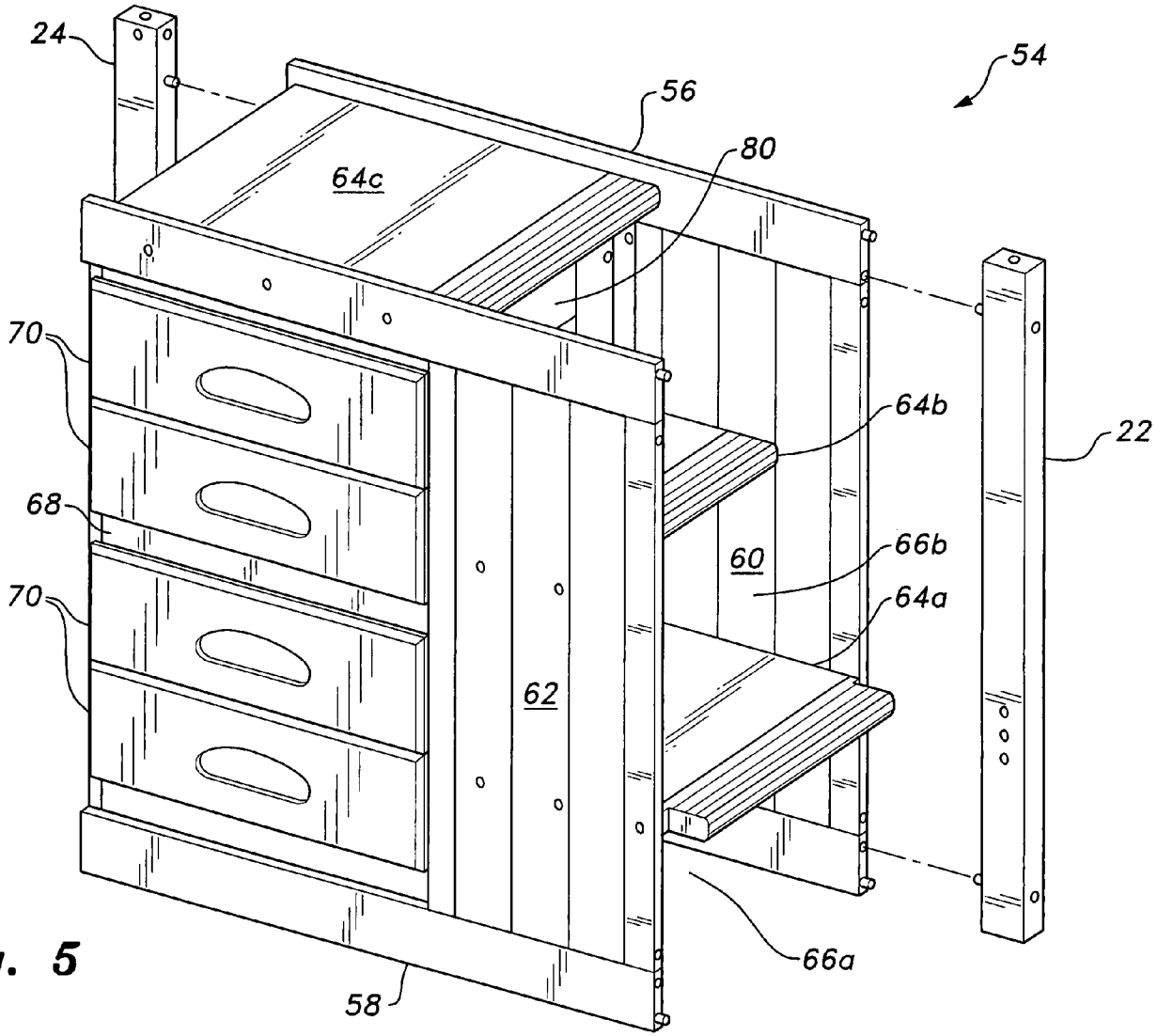
FIG. 5 is an exploded perspective view of the staircase assembly of a bunk bed with integral staircase according to the present invention, showing the initial step in converting the staircase for installation from one end of the bunks to the other end.

FIG. 5 illustrates the staircase assembly 54 at an early stage of disassembly from the first end 14 of the lower bunk 12, i.e., the configuration shown in FIGS. 1 through 4 of the drawings. In FIG. 5 the outboard post pair 68, 70 has already been removed, and the two lower bunk first end posts 22, 24 comprising the lower bunk first end post pair are shown separated from the edges of the first side 56. Once this has been accomplished, the two outboard posts 68, 70 are installed to the edges of the first side 56, with the lower bunk second end post pair 26 and 28 being installed to the edges of the second side 58 of the staircase assembly 54.

Figure 6:
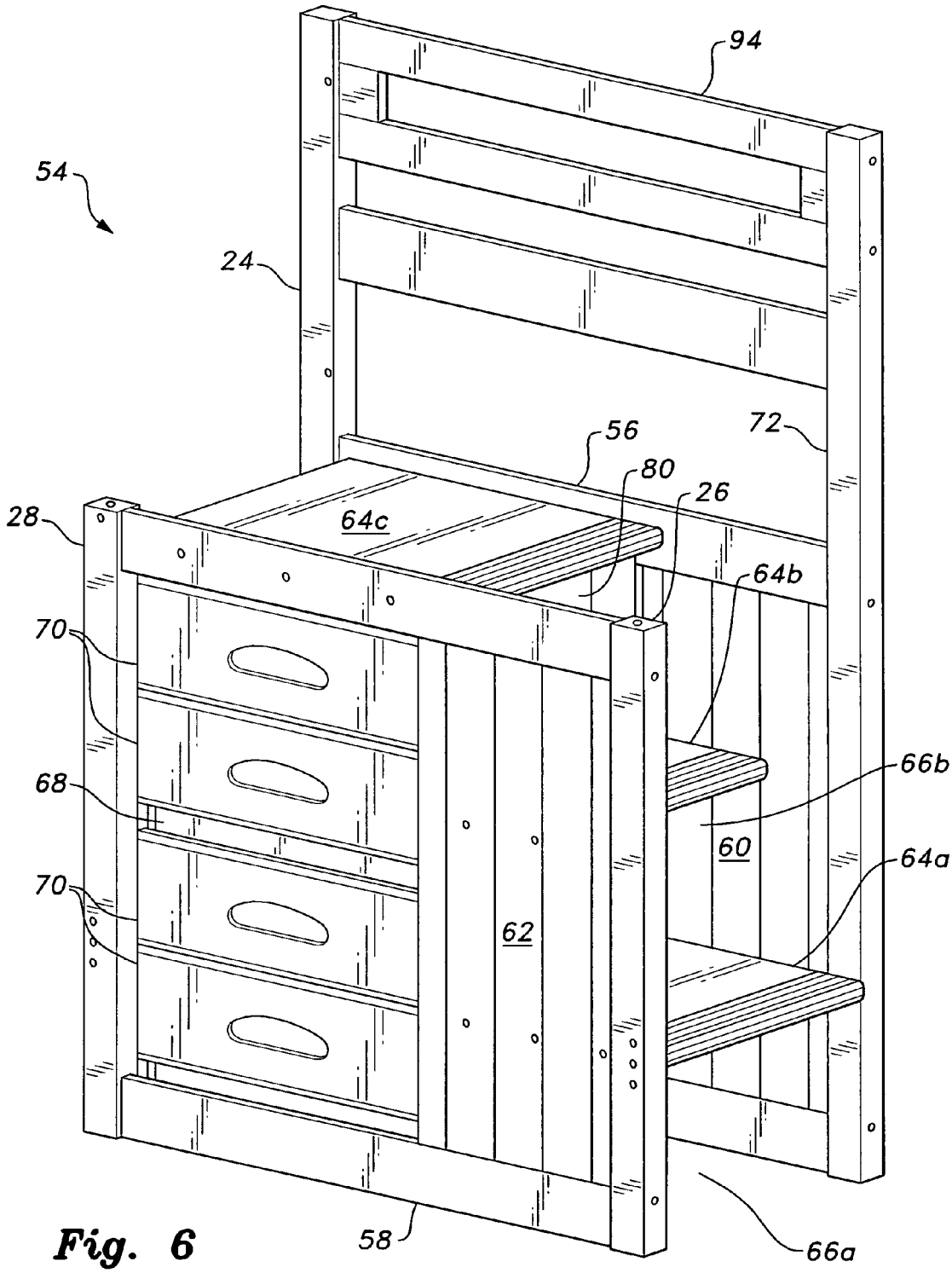
FIG. 6 is a perspective view of the staircase assembly and one end of a bunk bed with integral staircase according to the present invention, showing the second step in converting the staircase for installation from one end of the bunks to the other end.
Figure 7:
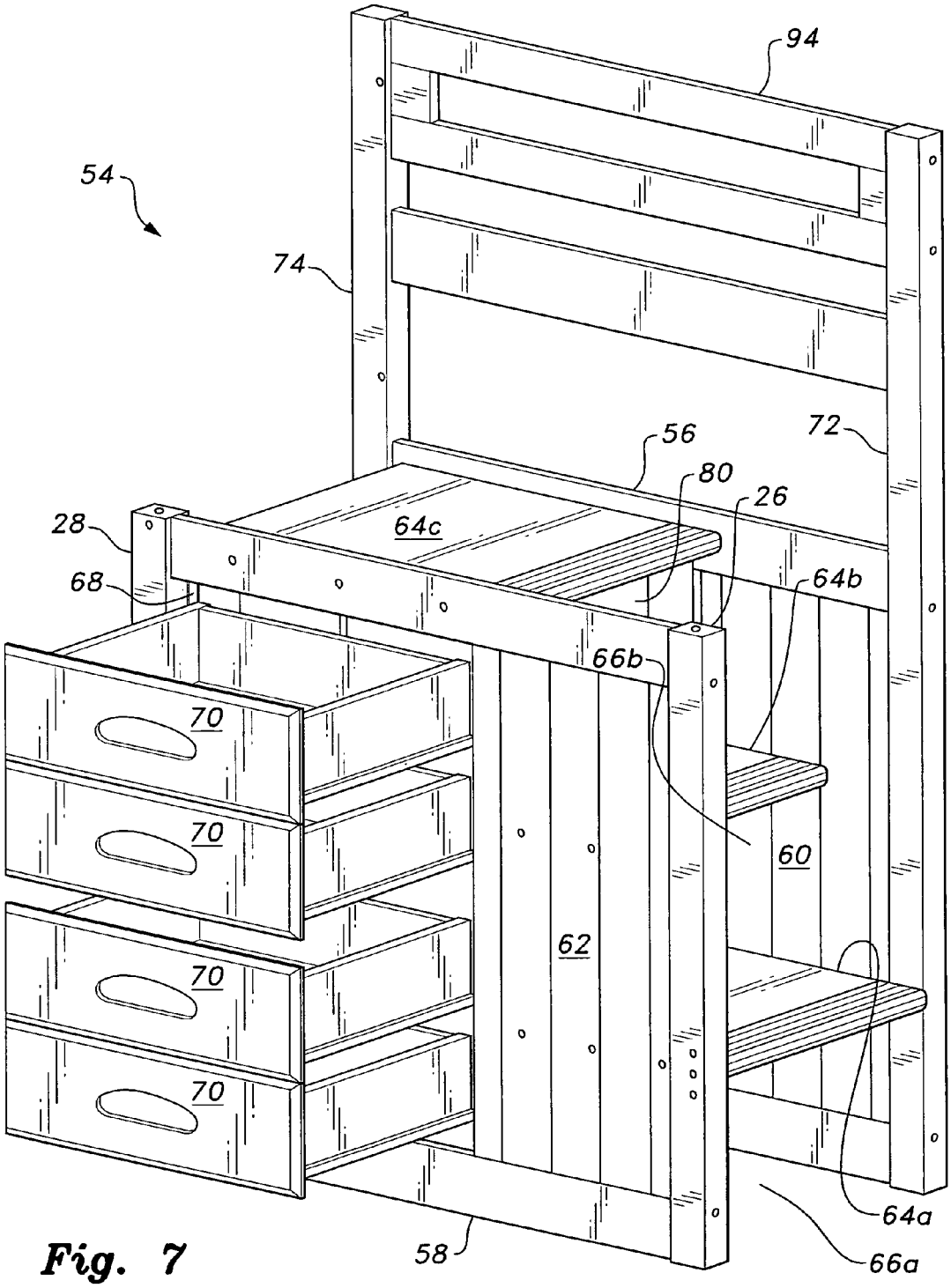
FIG. 7 is a perspective view of the staircase assembly and one end of the bunk bed with integral staircase according to the present invention, showing the third step in converting the staircase for installation from one end of the bunks to the other end.

Obviously, the staircase assembly 54 is not yet ready for installation to the second end 16 of the lower bunk 12 at the stage shown in FIG. 6, as the drawers would be facing the end of the lower bunk 12 rather than facing away from the lower bunk to provide for their opening. Accordingly, the staircase assembly 54 is configured to provide for the removal and reversal of the chest of drawers 68 therein, once the drawers 70 have been removed as shown in FIG. 7. The staircase assembly 54 includes an open back 76, best shown in FIGS. 9 and 10, where the chest of drawers 68 is being removed (FIG. 9) and reinstalled (FIG. 10) in the staircase 54 through the open back 76 thereof.

The chest of drawers 68 includes an open front providing for the installation of the drawers 70 therein, a closed back panel structure 78, and mutually opposed closed first and second side panels, respectively 80 and 82. Thus, the chest of drawers 68 is essentially a box having opposed closed sides 80 and 82 and back 78, with the top, bottom, and front (i.e., the drawer opening) being open. The two side panels 80, 82 serve as the vertical backing panels for the open stairway storage areas 66*a* and 66*b*, depending upon the orientation of the chest 68 within the staircase structure 54. In the example of FIGS. 1 through 4, it will be seen that the first side 80 of the chest of drawers 68 serves as the back panel for the open stairway storage areas 66*a*, 66*b* when the staircase assembly 54 is installed to the first end 14 of the lower bunk 12. The second side 82 of the chest serves this function when the staircase assembly 54 is installed to the second end 16 of the lower bunk 12, as shown in FIG. 14.

The chest of drawers 68 is secured within the staircase 54 by attaching the rearward structure of the chest 68 to the staircase 54 through the open side of the staircase 54 opposite the drawer extension side of the chest. Thus, in the configuration shown in FIGS. 1 through 8, the drawers 70 open through the second side 58 of the staircase assembly 54, and the back of the chest of drawers 68 is secured through the opposite first side 56 of the staircase. A number of different means may be used to accomplish this, but the preferred attachment is by means of an additional component, e.g., a magazine rack 84 as shown particularly in FIGS. 8 and 12, installed through the appropriate side of the staircase assembly 54, with the component fitting between the posts of the lower bunk end post pair, or more specifically between the inboard edges of the steps 64*a*, 64*b* and the rearward lower bunk end post, e.g., rearward first end post 24, as shown in FIG. 3. (It will be understood that the configuration shown in FIG. 8 is an intermediate step, with the lower bunk second end posts 26, 28 and outboard posts 72, 74 having been previously installed on the staircase assembly 54.)

Figure 8:
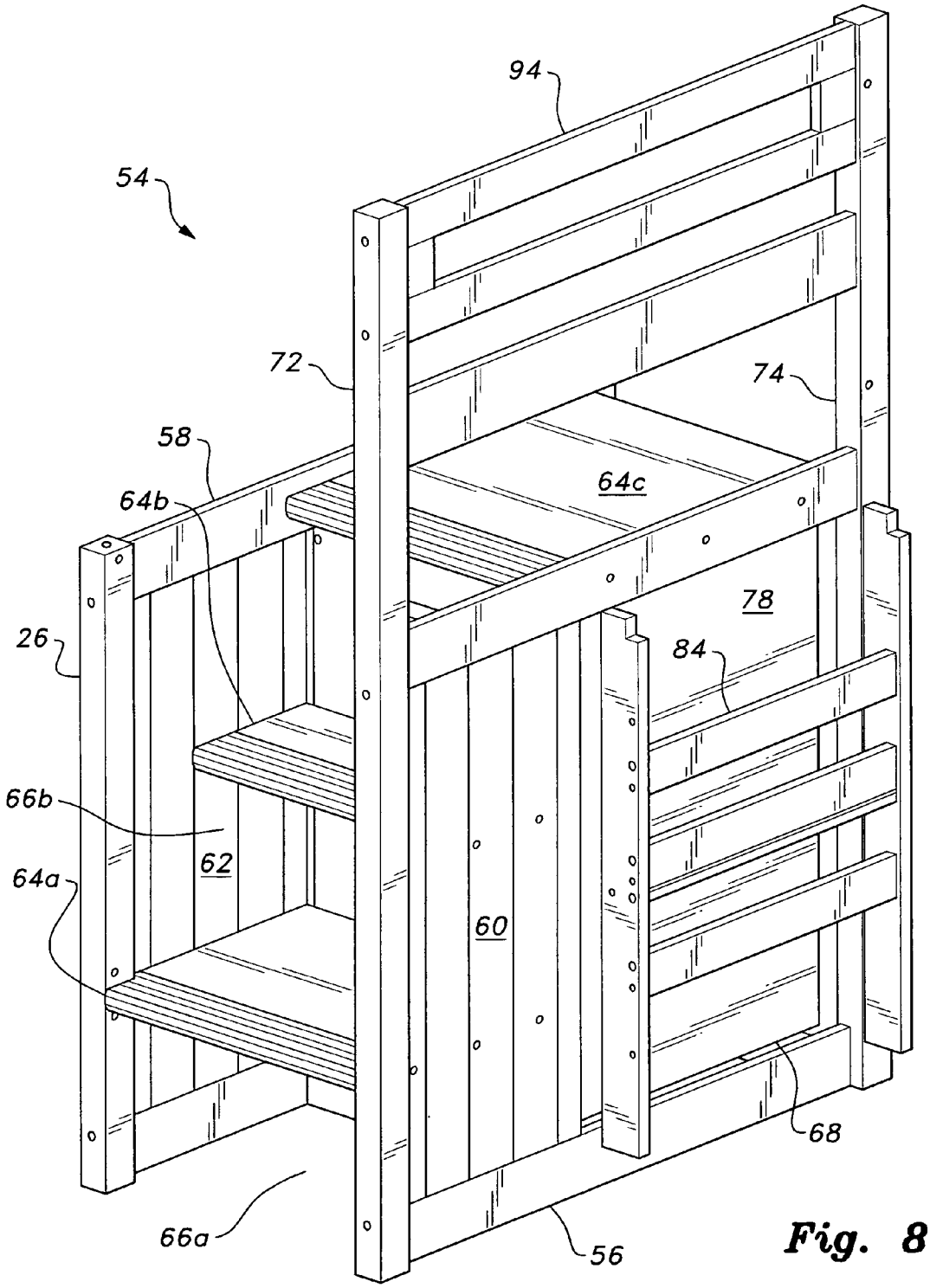
FIG. 8 is a perspective view of the staircase assembly and one end of a bunk bed with integral staircase according to the present invention, showing the fourth step in converting the staircase for installation from one end of the bunks to the other end.

The magazine rack 84 includes a pair of spaced apart vertical members with upper notches that engage the lower edge of the crossmember forming the upper edge of the side panel of the staircase assembly 54, e.g., the upper edge of the first side 56 as shown in FIG. 8. The lower ends of the magazine rack vertical members are screwed or otherwise attached to the structure of the staircase 54 to hold the rack in place. The vertical members of the rack 84 extend slightly into the interior of the staircase 54 and engage the closed back panel 78 and structure of the chest of drawers 68 to lock it in place in the staircase assembly 54, thereby preventing withdrawal of the chest of drawers 68 through the open back 76 of the staircase assembly.

Figure 9:
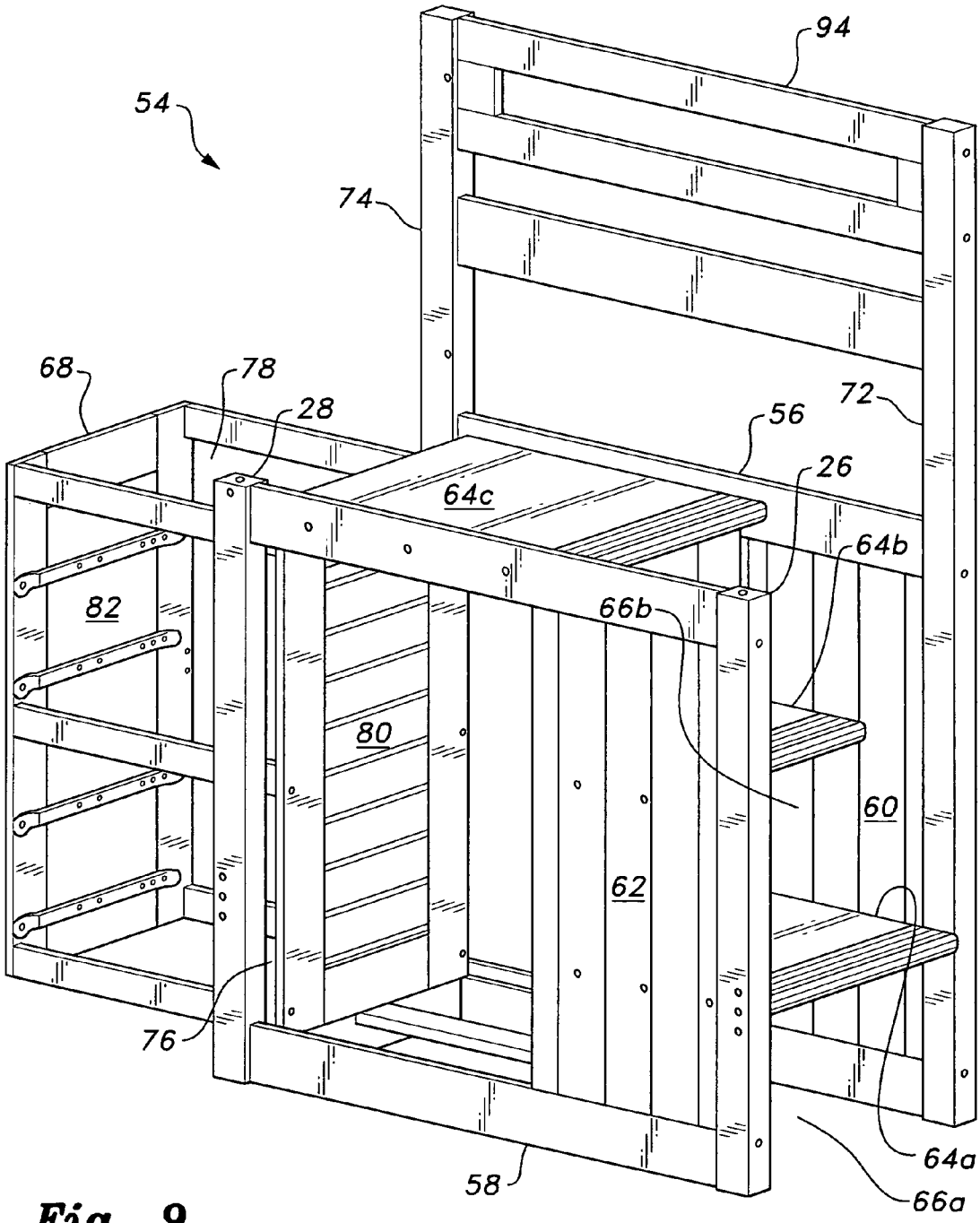
FIG. 9 is a perspective view of the staircase assembly and one end of a bunk bed with integral staircase according to the present invention, showing the fifth step in converting the staircase for installation from one end of the bunks to the other end.
Figure 12:
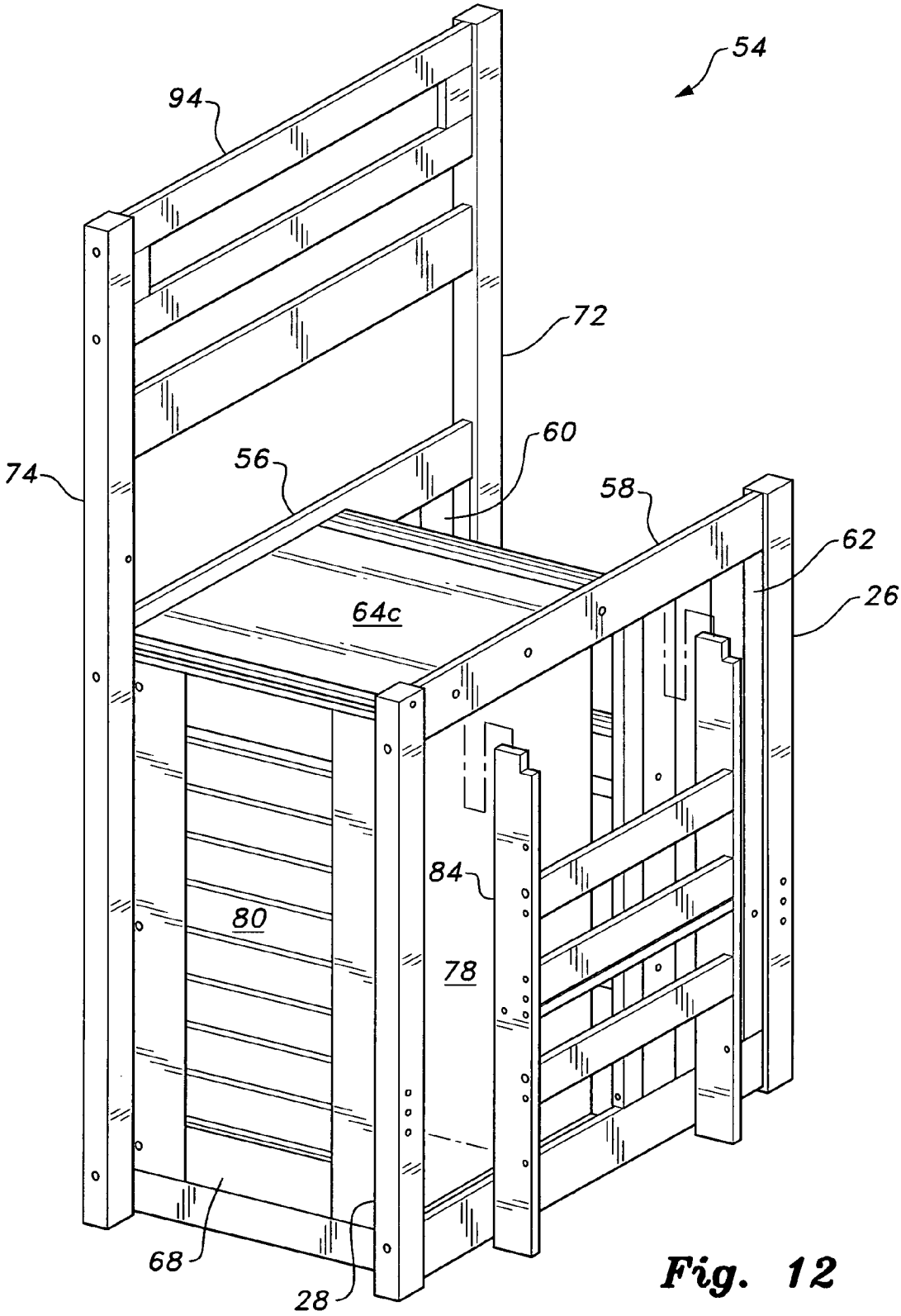
FIG. 12 is a perspective view of the staircase assembly and one end of the bunk bed with integral staircase according to the present invention, showing the eighth step in converting the staircase for installation from one end of the bunks to the other end.

Once the magazine rack 84 has been removed, the chest of drawers 68 can be slid outwardly through the open back 76 of the staircase assembly 54 as shown in FIG. 9 of the drawings. The chest 68 is then turned around through 180 degrees to position its second side 82 toward the steps 64*a*, 64*b* and align its open front with the first side 56 of the staircase assembly 54, generally as shown in FIG. 10 of the drawings. The chest of drawers 68 is then slid back into the staircase assembly 54 and the drawers 70 installed in the chest 68 through the first side 56 of the staircase 54, generally as shown in FIG. 11. The magazine rack 84 may then be installed between the lower bunk second end rear post 28 and the backs of the steps 64*a*, 64*b*, generally as shown in FIG. 12 of the drawings.

Figure 13:
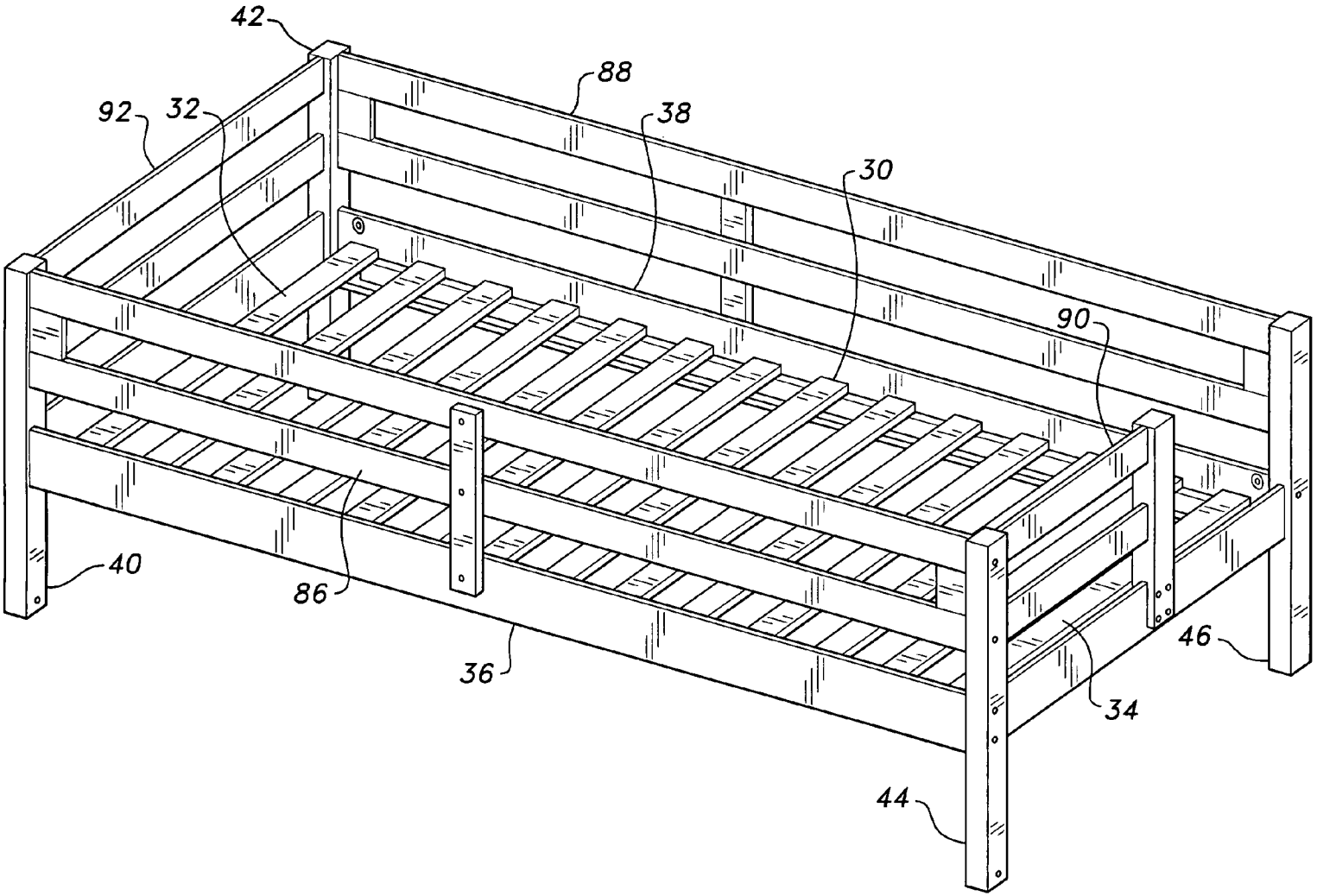
FIG. 13 is a perspective view of the upper bunk bed of a bunk bed with integral staircase according to the present invention, showing the assembly thereof for use with the bed assembly having the staircase at the opposite end from that shown in FIGS. 1 through 4.

At this point, the necessary alterations to the railing of the upper bunk 30 may be made, generally as shown in FIG. 13. The upper bunk 30 includes a forward and a rearward lateral rail, respectively 86 and 88, as shown in FIGS. 1 through 4, 13, and 14. These lateral rails 86, 88 may remain in place regardless of the location of the staircase 54 relative to either end of the bunk assembly. However, it is preferred that one of the end rails provide an opening for access from the upper landing 64*c* of the staircase assembly 54 to the upper bunk 30. Thus, the two end rails are constructed to provide a staircase end rail 90 having a relatively short length to provide an access opening between the staircase assembly 54 and the upper bunk 30, and a longer end rail 92 spanning the entire width of the upper bunk.

It will be noted that the shorter staircase end rail 90 is located at the first end 32 of the upper bunk 30 in FIGS. 1 through 4, in order to provide access to the upper bunk when the staircase 54 is attached to the first end 14 of the lower bunk 12. However, the two end rail assemblies 90 and 92 have been transposed in FIGS. 13 and 14 to provide for the installation of the staircase assembly 54 at the second end 16 of the lower bunk 12, with the full width end rail assembly 92 located at the first end 32 of the upper bunk and the shorter upper bunk access end rail assembly 90 located at the second end 34 of the upper bunk in FIGS. 13 and 14. An additional outboard safety rail assembly 94 is installed between the two outboard posts 72 and 74, i.e., over the outboard side of the stairway assembly 54 (the drawer opening side) when the staircase assembly 54 is installed to the bunks 12 and 30. Finally, a staircase end rail assembly 96 is installed between the appropriate upper bunk rearward end post 42 or 46 and the rearward outboard post 74. This staircase end rail assembly 96 spans between the upper bunk first end post 42 and the rearward outboard post 74 when the staircase assembly 54 is installed to the first end 14 of the lower bunk 12 as shown in FIGS. 1 through 4, but is switched to span between the upper bunk second end post 46 and the rearward outboard post 74 when the staircase assembly 54 is secured to the second end 16 of the lower bunk 12 as shown in FIG. 14.

Accordingly, the bunk bed and integral staircase 10 in its various embodiments provide a greatly improved structure for such an article of furniture, due to the elimination of the conventional ladder access to the top bunk and the addition of a stairway integrally attached to the bed assembly. The integral attachment of the staircase to the bed assembly greatly enhances safety by assuring that the stairs cannot move or slip relative to the bed structure in the event that some lateral force is applied to the stairs. Yet, the versatility provided by the bed and stairway components allows the staircase assembly to be installed to either end of the beds, and further allows the staircase to be switched from one end to the other with minimal effort. The additional storage space provided beneath the steps and in the chest removably and reversibly installed beneath the landing, is also a welcome benefit of the integral staircase component. The structure of the bunk beds with their integral staircase thus provides a number of advantages not previously developed in the art.

It is to be understood that the present invention is not limited to the embodiments described above, but encompasses any and all embodiments within the scope of the following claims.

I claim:

1. A bunk bed with integral staircase, comprising:

a lower bunk having a first end and a second end opposite the first end, the first end having a forward first end post and a rearward first end post defining a lower bunk first end post pair, the second end having a forward second end post and a rearward second end post defining a lower bunk second end post pair;

an upper bunk having a first end and a second end opposite the first end, the first end having a forward first end post and a rearward first end post defining an upper bunk first end post pair, the second end having a forward second end post and a rearward second end post defining an upper bunk second end post pair, the posts of the upper bunk being atop the respective posts of the lower bunk; and a staircase having mutually opposed first and second sides and an upper landing extending across the sides, the staircase also having a forward outboard post and a rearward outboard post, the outboard posts being selectively and interchangeably installed on either of the sides of the staircase, the side of the staircase opposite the outboard posts being attached to one of the lower bunk end post pairs.

2. The bunk bed with integral staircase according to claim 1, wherein the staircase has a front and an open back, the bunk bed with integral staircase further comprising:

a plurality of steps in the front of the staircase; and a chest of drawers removably and reversibly installed within the staircase through the open back, the chest of drawers having at least one drawer opening, a closed back opposite the drawer opening, and mutually opposed first and second sides extending between the drawer opening and the back.

3. The bunk bed with integral staircase according to claim 1, wherein the staircase has an open front, the bunk bed with integral staircase further comprising:

a plurality of steps in the staircase;

a chest of drawers installed within the staircase, the chest of drawers having at least one drawer opening congruent with one of the sides of the staircase; and a drawer installed within the chest of drawers, the drawer selectively extending from the drawer opening.

4. The bunk bed with integral staircase according to claim 1, wherein the staircase has a front having a plurality of steps, each of the steps defining an open storage area there beneath.

5. The bunk bed with integral staircase according to claim 1, further comprising:

a chest of drawers removably installed within the staircase; and a magazine rack installed between the posts of one of the lower bunk end post pairs and engaging the chest of drawers, thereby locking the chest of drawers within the staircase.

6. The bunk bed with integral staircase according to claim 1, wherein the lower bunk has a greater width than the upper bunk.

7. The bunk bed with integral staircase according to claim 1, further comprising at least one drawer selectively extending laterally from the lower bunk.

8. A bunk bed with integral staircase, comprising:

a lower bunk having a first end and a second end opposite the first end, the first end having a forward first end post and a rearward first end post defining a lower bunk first end post pair, the second end having a forward second end post and a rearward second end post defining a lower bunk second end post pair;

an upper bunk having a first end and a second end opposite the first end, the first end having a forward first end post and a rearward first end post defining an upper bunk first end post pair, the second end having a forward second end post and a rearward second end post defining an upper bunk second end post pair, the posts of the upper bunk being atop the respective posts of the lower bunk;

a staircase assembled to and extending from one end of the lower bunk, the staircase having mutually opposed first and second sides, a front having a plurality of steps therein, and an open back; and a chest of drawers removably and reversibly installed within the staircase through the open back thereof, the chest of drawers having at least one drawer opening, a closed back opposite the drawer opening, and mutually opposed first and second sides extending between the drawer opening and the back.

9. The bunk bed with integral staircase according to claim 8, wherein the staircase has an upper landing extending between the first and second sides, a forward outboard post, and a rearward outboard post, the outboard posts being selectively and interchangeably attached to either of the sides of the staircase, the side of the staircase opposite the outboard posts being attached to one of the lower bunk end post pairs.

10. The bunk bed with integral staircase according to claim 8, wherein the at least one drawer opening of the chest of drawers is congruent with one of the sides of the staircase, the bunk bed with integral staircase further comprising a drawer installed within the chest of drawers and selectively extending from the drawer opening.

11. The bunk bed with integral staircase according to claim 8, wherein each of the steps of the staircase defines an open storage area therebeneath.

12. The bunk bed with integral staircase according to claim 8, further comprising a magazine rack installed between the posts of one of the lower bunk end post pairs and engaging the chest of drawers, thereby locking the chest of drawers within the staircase.

13. The bunk bed with integral staircase according to claim 8, wherein the lower bunk has a greater width than the upper bunk.

14. The bunk bed with integral staircase according to claim 8, further comprising at least one drawer selectively extending laterally from the lower bunk.

15. A bunk bed with integral staircase, comprising:

a lower bunk having a first end and a second end opposite the first end, the first end having a forward first end post and a rearward first end post defining a lower bunk first end post pair, the second end having a forward second end post and a rearward second end post defining a lower bunk second end post pair;

an upper bunk having a first end and a second end opposite the first end, the first end having a forward first end post and a rearward first end post defining an upper bunk first end post pair, the second end having a forward second end post and a rearward second end post defining an upper bunk second end post pair, the posts of the upper bunk being atop the respective posts of the lower bunk;

a staircase assembled to and extending from one end of the lower bunk, the staircase having mutually opposed first and second sides and a front having a plurality of steps therein;

a chest of drawers installed within the staircase, the chest of drawers having at least one drawer opening congruent with one of the sides of the staircase; and a drawer installed within the chest of drawers and selectively extending from the drawer opening.

16. The bunk bed with integral staircase according to claim 15, wherein the staircase has an upper landing extending between the opposing sides of the staircase, a forward outboard post, and a rearward outboard post, the outboard posts being selectively and interchangeably attached to either of the sides of the staircase, the side of the staircase opposite the outboard posts being attached to either of the lower bunk end post pairs.

17. The bunk bed with integral staircase according to claim 15, wherein the staircase has an open back, the chest of drawers being removably and reversibly installed within the staircase through the open back thereof, the chest of drawers having at least one drawer opening, a closed back opposite the drawer opening, and mutually opposed first and second sides extending between the drawer opening and the back.

18. The bunk bed with integral staircase according to claim 15, wherein each of the steps of the staircase defines an open storage area therebeneath.

19. The bunk bed with integral staircase according to claim 15, wherein the chest of drawers is removably installed within the staircase, the bunk bed with integral staircase further comprising a magazine rack installed between the posts of one of the lower bunk end post pairs and engaging the chest of drawers, thereby locking the chest of drawers within the staircase.

20. The bunk bed with integral staircase according to claim 15, wherein the lower bunk has a greater width than the upper bunk and at least one drawer selectively extends laterally from the lower bunk.

* * * * *